US006481184B1

(12) United States Patent
Junker et al.

(10) Patent No.: US 6,481,184 B1
(45) Date of Patent: Nov. 19, 2002

(54) METHOD AND APPARATUS FOR FASTENING OF TUBULAR BAGS ON A HANGER STRIP

(75) Inventors: Gerhard Junker, Bad Nauheim; Dieter Keim, Langgoens, both of (DE)

(73) Assignee: Hastamat Verpackungstechnik GmbH + Co. KG, Lahnau (DE)

( * ) Notice: Subject to any disclaimer, the term of this patent is extended or adjusted under 35 U.S.C. 154(b) by 0 days.

(21) Appl. No.: 09/650,202

(22) Filed: Aug. 29, 2000

(30) Foreign Application Priority Data

Aug. 30, 1999 (DE) ..... 199 41 431

(51) Int. Cl.[7] ..... B65B 9/20; B65B 29/04

(52) U.S. Cl. ..... 53/413; 53/451; 53/134.1; 53/551; 53/591

(58) Field of Search ..... 53/397, 413, 451, 53/134.1, 580, 591, 551

(56) References Cited

U.S. PATENT DOCUMENTS 2,272,623 A * 2/1942 Runner ..... 206/466
3,331,182 A * 7/1967 Hannon ..... 53/459
4,093,493 A * 6/1978 Welch ..... 53/580
4,617,784 A * 10/1986 Golicz ..... 53/591
5,433,060 A * 7/1995 Gur ..... 53/134.1

* cited by examiner

*Primary Examiner*—John Sipos
(74) *Attorney, Agent, or Firm*—Flynn, Thiel, Boutell & Tanis, P.C.

(57) ABSTRACT

The invention relates to a method and an apparatus for the manufacture of bags and the fastening of same in groups on a hanger strip. The purpose is hereby attained according to the invention by the bag filled with the product being, after the formation of a first closing seam, subjected to a second method step such that after the advance of one bag length the second closing seam is formed, while at the same time a hanger strip is fastened on the first closing seam. Furthermore an apparatus for the manufacture of the bags and for grouping said bags on a hanger strip is described.

21 Claims, 4 Drawing Sheets

METHOD AND APPARATUS FOR FASTENING OF TUBULAR BAGS ON A HANGER STRIP

DESCRIPTION

The invention relates to a method for the manufacture of tubular bags, which are subsequently fastened on a strip in such a manner that they are arranged partially overlapped one on top of the other. The invention relates further more to an apparatus for the manufacture of the bags and to their above-described arrangement.

When manufacturing tubular bags, the initially flat foil is pulled off from a roll, is guided over a forming shoulder and is shaped into a plastic tube with a longitudinal lap joint, which in turn encloses a fill pipe adapted to its shape. After the longitudinal joint has been sealed into a longitudinal seam, a bottom seam is produced with a first cross-sealing device. When the tubular bag is filled through the fill pipe, its closing occurs through a top seam created with a second cross-sealing device, whereby at the same time the bottom seam for the next following plastic tube is sealed.

New avenues for sales and changing demands by the consumer require continuously innovative sales methods and thus consequently new forms for packaging. The tubular bag shows here multiple possibilities for variations, whereby both in economical and ecological respects a material-saving handling of the packaging material is guaranteed.

A form of packaging is known from the state of the art in which the tubular bag is moved onto one individual, suitably designed or onto a curved rod. Usually a suitable punch-out is for this purpose provided in the top seam, which punch-out is either only circular or has in addition a slot on both sides. The respective tool for the last-mentioned design is known to the man skilled in the art as the Eurohole punch.

Furthermore a form of packaging is known in which, in order to hang and present the packages, a hanger strip, for example of cardboard, is used. The strip has on the one hand a punch-out for facilitating a hanging onto sales posts and on the other hand a certain number of further punch-outs in order to receive the bags. The top seam of the respective bag is hereby placed into the associated punch-out so that a fixation through clamping occurs. The distances between the bags or the punch-outs can be chosen such that these rest partially in their length one on top of the other. A scale-like arrangement of the packages is achieved in this manner. Furthermore a relatively high package density is obtained, whereby the presentation with the complete printing on the front side of such bag is guaranteed as the consumer removes the sequence of bags from the hanger strip.

Packages of the above-described type are preferably utilized for products like snack foods (potato chips, peanuts) or sweets. The form of packaging is suited ideally for use in stores with special displays as, for example, gas-station shops.

The packages are manufactured according to the state of the art as follows: The products are packaged on a tubular-bagging machine. Machines of this type are sufficiently described in the technical literature and have been on the market for many decades. A description is therefore not needed.

The hanger strip is manually removed from the delivery bundle.

The bags are now also manually one after the other placed with the top seam into the provided punch-outs.

The hanger strip can subsequently be placed with the inserted bags into a transport package, whereby also this method step is generally carried out manually.

This method is disadvantageous since the manual work results in high employee expenses, which make the package unnecessarily more expensive. Furthermore no reproducible quality can be created so that again and again packages are insufficiently inserted into the box and can fall off the latest when being hung onto the display post. A total loss of the package must then be expected in the provided sales areas.

For this reason it is being tried again and again to automate this packaging process. It is hereby being tried to position the bags manufactured on the tubular-bagging machine by means of suitable sorting and grouping devices in such a manner that the above-described hanger strip can be fastened on the bag. This process has the disadvantage that a bag, after it was released after its manufacture, is almost impossible to position exactly. The fixing process thus demands a very high technical and mechanical expertise, which is in no relationship to the production safety.

The present invention has therefore the purpose to overcome the afore-described disadvantages during the manufacture of the afore-described packaging form and to enable with simple means an automatic manufacture with little expense.

The purpose is attained according to the invention by the bag filled with the product being, after the formation of the first closing seam, subjected to a second method step during which, after the advance of one bag length, the second closing seam is formed, while at the same time a hanger strip is fastened on the first closing seam.

Further characteristics of the invention are contained in the subclaims.

The invention does not only eliminate the earlier discussed deficiencies of the state of the art. Instead an enormous potential for increase of the production with an extremely low expense in investment results from this for the user.

A particular characteristic of the invention is that the mounting of the hanging strip occurs already during the bag-manufacturing process. The advantage of this is that the bag is practically fixed in this phase so that the mounting of the strip is possible through simple means. Furthermore a packaging sequence free of any interference is guaranteed only in this manner.

The hanger strips are also supplied automatically. The strip can be made, for example, of a cardboard material or of a plastic foil. It is furthermore possible that the strips are taken in a customized length from a magazine and are fed to the manufacturing process, or are pulled off from a roll and are automatically cut off after a preselected length.

Many possibilities exist for mounting the bags on the hanger strip, whereby only a few will be mentioned here. When the strip has a sealing layer the connection to the bag can occur through hot sealing. With suitably chosen materials a welding is also conceivable. A further possibility is to use an adhesive (for example hotmelt) so that a connection is subsequently created by contact pressure. Also a fixation by means of clamps or by clamping is possible with the help of suitable devices.

The sales-enhancing and space-saving scale-like arrangement can be achieved by making the distances between the bag fixation locations on the hanger strip less than the bag length. The method of the invention and also the corresponding apparatus guarantee that here too the representative bag front side faces the viewer. This means in turn that the back side of the bag with the longitudinal seam is covered by the hanger strip. By suitably adjusting the advance of the hanger strip it is also possible to adjust the overlapping of the respective bags. When various distances are needed for the respective package types or products, then the adjustment of the advance can also occur automatically. A pressure mark can, for example, be provided on the hanger strip, which is registered by a suitable recognizing apparatus. In this manner it is also possible to automatically adjust the number of attached bags and the hanger strip can be cut off at the suitable spot.

The bags are in an advantageous embodiment fastened "overhead" on the hanger strips. After the second seam has been formed, the closed bag is separated in the sealing station from the next package by means of a separating knife. The bag tilts now forwardly at 180°. It is in addition conceivable that this tilting is passively or actively supported by a device. For example, metal guides or a blowing device are mentioned here. This method step has now the advantage that the face of the bag carrying the advertisement shows in front and the longitudinal seam is, as desired, covered by the hanger strip. It is furthermore possible to use during the release of the bag, if the strip was sealed or welded on, the so-called peel effect. The bag can in this manner be released from the strip with relatively little force.

BRIEF DESCRIPTION OF THE DRAWINGS

The invention will be discussed in greater detail hereinafter in connection with one exemplary embodiment and the drawings, in which.

DETAILED DESCRIPTION OF THE INVENTION

Figure 1:
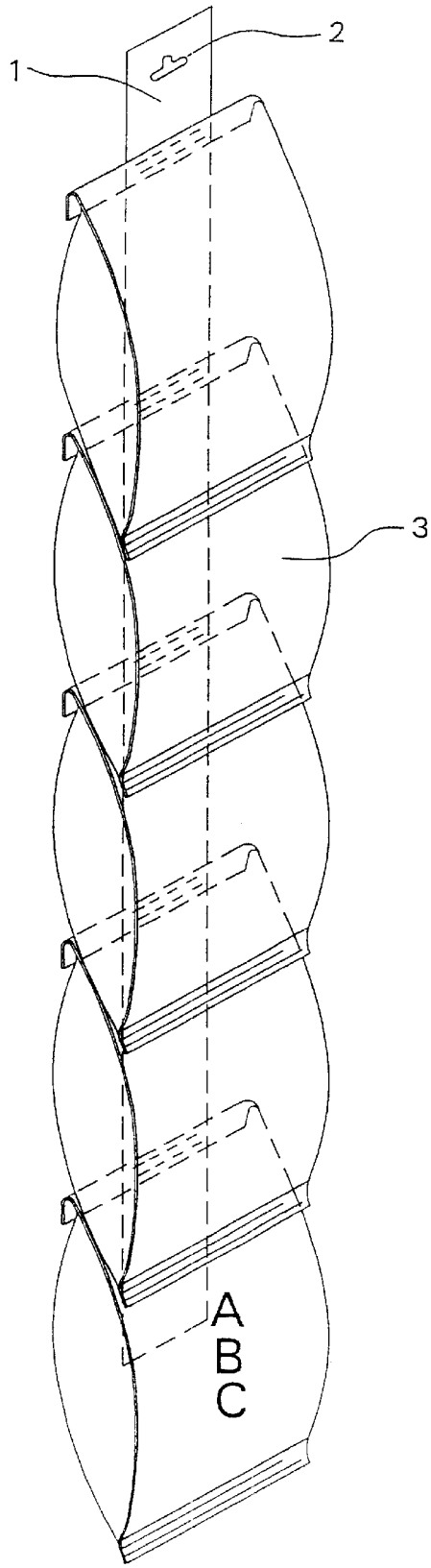
FIG. 1 illustrates a bag package with hanger strip, as it is known from the state of the art.

FIG. 1 illustrates a package, which consists of a hanger strip 1 and a specified number of bags 3. The strip has a Eurohole punch-out 2, with the help of which the package can be hung on the package storage post. The bags 3 are scale-like superposed.

Figure 2:
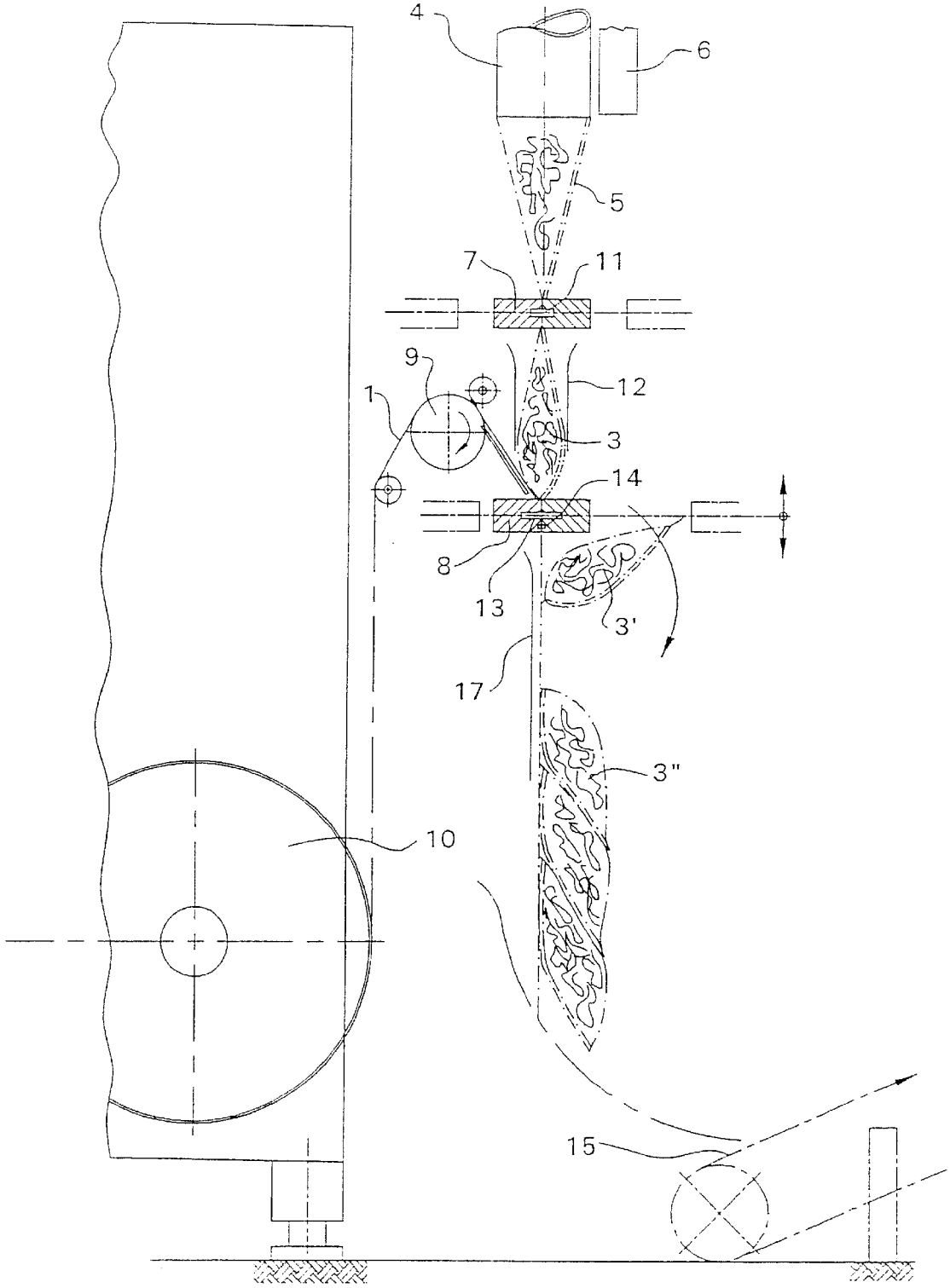
FIG. 2 illustrates an apparatus, with the help of which such a package is automatically packaged according to the invention.

FIG. 2 illustrates the manufacture with the help of an exemplary embodiment. The respective bag 3 is filled via the fill pipe 4 after the foil tube 5 has been closed off in longitudinal direction by means of the longitudinal sealing station 6 and the bottom seam by means of the cross-sealing station 7. The sealing jaws of the cross-sealing station 7 move thereafter away from one another and the foil is pulled off by one bag length. The sealing jaws move thereafter again toward one another and form at the same time the top seam of the filled bag and the bottom seam of the next bag.

A second station 8 exists below this first cross-sealing station 7. The hanger strip 1 is now pulled off from the storage reel 10 through a pull-off station 9, which is here illustrated as delivery rollers, and is fed to the second cross-sealing station 8. While now the top seam of the filled bag 3 has been created, the sealing of the hanger strip 1 on the bag 3 takes now place in this station. The strip 1 is preferably sealed on the bottom seam of the bag 3. The vertical fixation of the bag 3 is supported by a metal holding plate 12.

After the strip 1 has been applied and the top seam has been formed, the bag is separated in the upper cross-sealing station 7 by means of a separating knife 11. The sealing tools of both stations 7 and 8 move thereafter away from one another and release the bag 3. From being top-heavy, the bag 3 now tips forwardly at 180° as the strip is moved farther forwardly a corresponding length. The metal guide 17, shown in FIG. 2, ensures that the bag 3 tips forwardly. The bag then rests with the longitudinal seam side on the earlier created bags 3" so that a scale-like arrangement results.

A separating knife 13 is furthermore integrated into the closing station 8, with which knife the hanger strip can be cut off after a specified length and/or number of bags. It is hereby advantageous to integrate a punching tool 14 into the sealing tools of the station 8 in order to create the hanger hole 2.

The chain of bags together with the hanger strips is subsequently guided through a metal guide onto, for example, a conveyor belt 15.

The second cross-sealing or closing station 8, in some embodiments, attaches or clamps the bags to the hanger strip 1. In other embodiments the closing station 8 includes tools that weld the bag to the hanger strip 1

Figure 3:
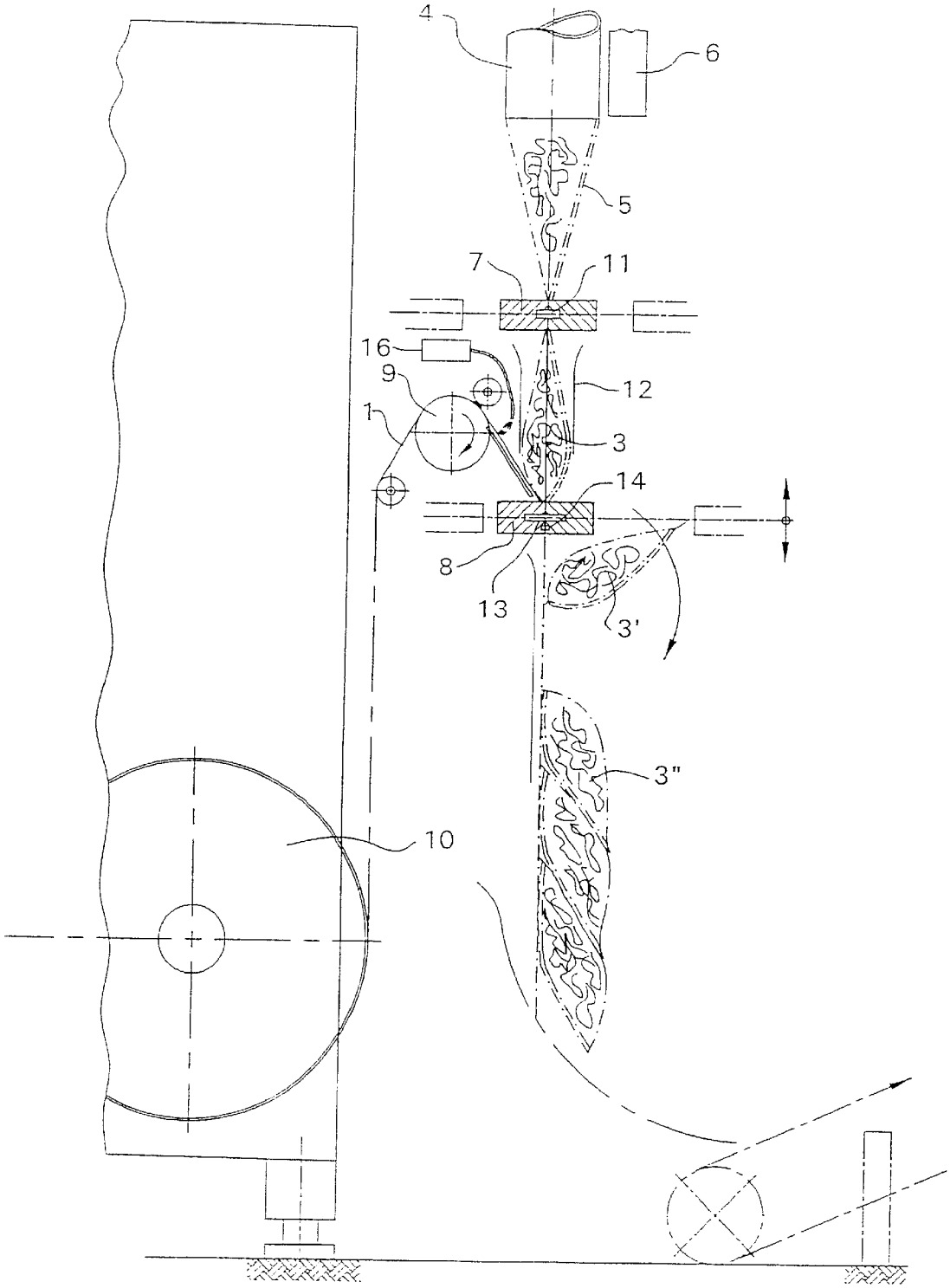
FIG. 3 illustrates an apparatus similar to the apparatus of FIG. 2, except that the second station applies an adhesive.

FIG. 3 is the same as the embodiment of FIG. 2, except the second station 8 includes an adhesive application device 16. The application device 16 provides an adhesive (for example hotmelt) and other tools of the second station 8 secure the bag to the hanger strip.

Figure 4:
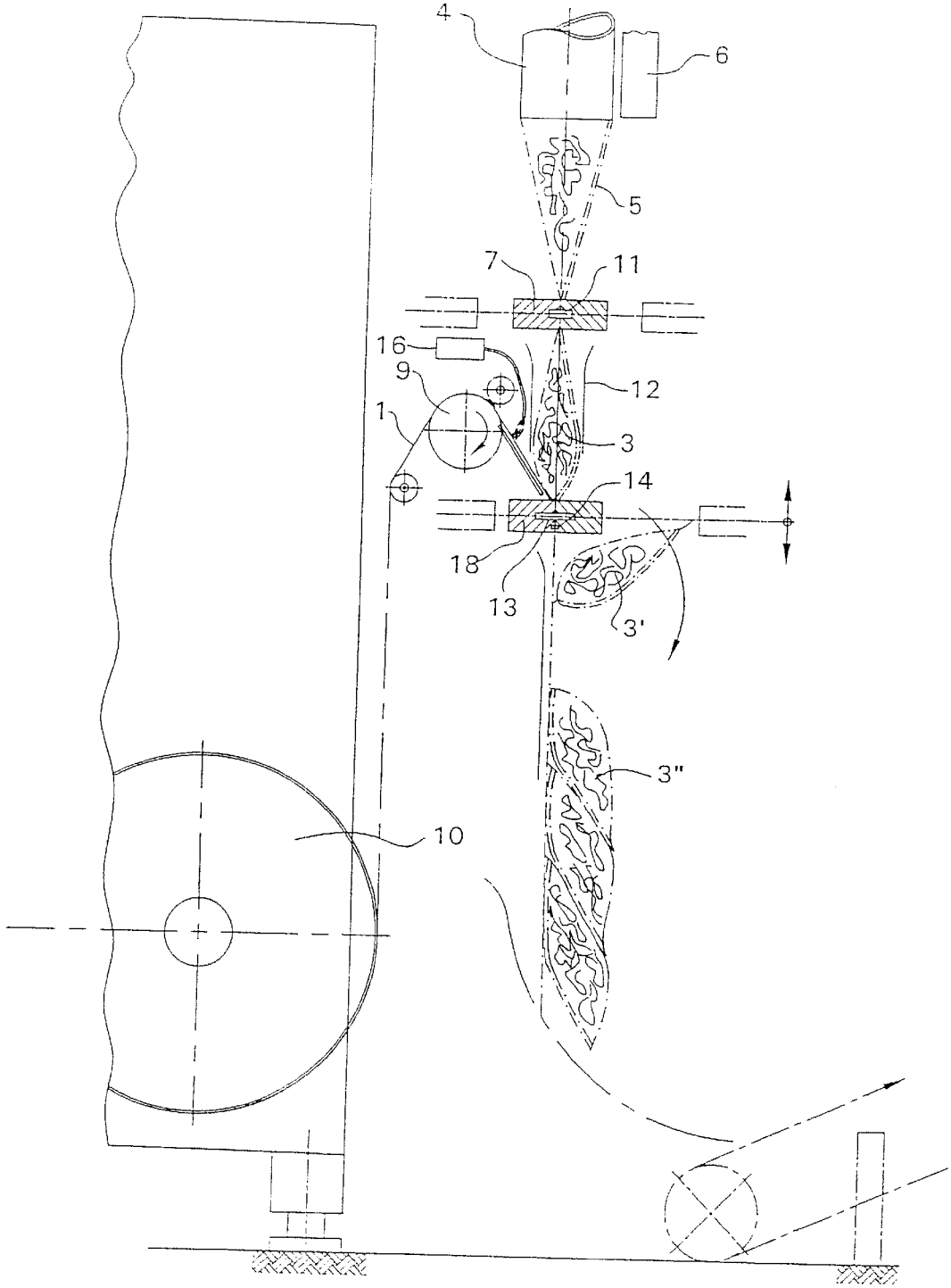
FIG. 4 illustrates an apparatus similar to the apparatus of FIG. 2, except that the second station has a clamping function.

FIG. 4 is the same as the embodiment of FIG. 2, except the second station is replaced by a clamping device 18 for clamping the bags 3 to the hanger strip 1.

The invention is not to be limited to the exemplary embodiment, which serves essentially to illustrate the invention. Other developments are also possible within the scope of the invention.

What is claimed is:

1. A method for the manufacture, filling and grouping of plastic bags, comprising the steps of:

advancing a first flat foil from a roll;

forming the flat foil into a tube having longitudinal lap joints using a forming shoulder;

subsequently sealing the lap joints;

forming a first closing seam defining a closed bottom portion at a bottom end of a bag;

subsequently filling the bag having the closed bottom with a product;

advancing the bag a specific bag length;

forming a second closing seam defining a closed top portion at a top end of the bag, while simultaneously securing a hanger strip at the first closing seam at the bottom end of the bag; and repeating the steps to form a plurality of the bags secured to the hanger strip.

2. The method according to claim 1, including the step of automatically feeding the hanger strip.

3. The method according to claim 1, including the steps of pulling the hanger strip off from a hanger strip roll and cutting the hanger strip to length after securement of a suitable number of the bags.

4. The method according to claim 1, including the step of automatically individually feeding the hanger strips.

5. The method according to claim 1, including the step of rotating the bag about 180° after securement to the hanger strip.

6. The method according to claim 1, wherein, after mounting of a preselected number of the bags to the hanger strip, a punching tool creates a punch-out in the hanger strip for hanging the hanger strip.

7. The method according to claim 1, wherein the number of bags per strip is adjustable.

8. A tubular-bagging machine according to the method of claim 1, comprising:

a pull-off mechanism resting on a fill pipe;

a forming shoulder;

a first cross-sealing station for sealing the top end of the bag and the lower end of an adjacent one of the bags; and a closing station spaced below the cross-sealing station, the closing station receiving the hanger strip from a device, wherein the closing station secures the hanger strip to the bag.

9. The tubular-bagging machine according to claim 8, wherein the closing station includes welding tools.

10. The tubular-bagging machine according to claim 8, wherein the closing station secures the bags to the hanger strip with an adhesive.

11. The tubular-bagging machine according to claim 8, wherein the closing station clamps the bag to the hanger strip.

12. The tubular-bagging machine according to claim 8, including a punch-out tool for forming an aperture in hanger strip.

13. The tubular-bagging machine according to claim 8, wherein the bag, during mounting of the hanger strip, is conveyed through a metal guide or a metal holding plate.

14. The tubular-bagging machine according to claim 8, wherein the bag, after being mounted on the strip, is passively rotated about 180° with assistance from a metal guide device.

15. The tubular-bagging machine according to claim 8, including a storage roller for providing the hanger strip.

16. The tubular-bagging machine according to claim 8, including a punch-out station housed in the closing station for periodically providing a hanger punch-out.

17. The tubular-bagging machine according to claim 8, including a separating knife housed in the closing station for periodically forming a hanger slot.

18. The tubular-bagging machine according to claim 8, wherein the distance between the closing station and the cross-sealing station is adjustable.

19. The method according to claim 1, wherein the step of forming the second closing seam at the top end of the bag includes simultaneously forming the first closing seam at the bottom end of a following one of the bags.

20. The method according to claim 19, including the step of severing between the first closing seam and the second closing seam to separate the bags.

21. The method according to claim 1, including, after securing the first closing seam of the bag to the hanger strip, the step of advancing the bag and the hanger strip so that the bag rotates about the bottom end which is secured to the hanger strip.

* * * * *